US009790658B2

(12) United States Patent
Kent

(10) Patent No.: US 9,790,658 B2
(45) Date of Patent: Oct. 17, 2017

(54) BUCKET WITH INTEGRATED HYDRAULIC DRUM

(71) Applicant: Derek W Kent, Becker, MN (US)

(72) Inventor: Derek W Kent, Becker, MN (US)

( * ) Notice: Subject to any disclaimer, the term of this patent is extended or adjusted under 35 U.S.C. 154(b) by 285 days.

(21) Appl. No.: 13/975,372

(22) Filed: Aug. 26, 2013

(65) Prior Publication Data

US 2014/0079520 A1 Mar. 20, 2014

Related U.S. Application Data

(60) Provisional application No. 61/703,532, filed on Sep. 20, 2012.

(51) Int. Cl.
*E02F 3/40* (2006.01)

(52) U.S. Cl.
CPC ..... *E02F 3/40* (2013.01); *E02F 3/401* (2013.01)

(58) Field of Classification Search
CPC ..... E02F 3/40; E02F 3/401
See application file for complete search history.

(56) References Cited

U.S. PATENT DOCUMENTS 3,481,056 A * 12/1969 Meade ..... E02F 3/401 346/33 WL
3,767,262 A * 10/1973 Pentith ..... E01C 23/088 172/122
4,023,288 A * 5/1977 Roe ..... E02D 3/032 172/464
4,490,070 A * 12/1984 Upchurch ..... E02D 3/032 37/403
4,852,277 A * 8/1989 Ward ..... E02F 3/402 299/39.2
5,423,137 A * 6/1995 Cochran ..... E02F 3/962 37/403
5,592,761 A * 1/1997 Ward ..... E02F 3/20 37/403
6,626,499 B1 * 9/2003 Schenk ..... E01C 23/088 299/39.1

* cited by examiner

*Primary Examiner* — Scott Lowe
(74) *Attorney, Agent, or Firm* — Gutwein Law; Greg N. Geiser

(57) ABSTRACT

A bucket for a loader with integrated hydraulic cylinder is disclosed. The hydraulic cylinder is mounted at the bottom of the bucket and extends the width of the bucket in a pocket between the bottom side and rear wall of the bucket. This allows the hydraulic cylinder to be used to manipulate materials at an exterior of the bucket. The bucket allows the user to use the bucket to both move and manipulate materials without having to use multiple attachments.

6 Claims, 4 Drawing Sheets

BUCKET WITH INTEGRATED HYDRAULIC DRUM

CROSS REFERENCE TO RELATED APPLICATIONS

This application claims priority to U.S. Provisional Patent Application No. 61/703,532 filed Sep. 20, 2012 to the above named inventor.

FEDERALLY SPONSORED RESEARCH OR DEVELOPMENT

Not Applicable

SEQUENCE LISTING, A TABLE, OR A COMPUTER PROGRAM

Not Applicable

FIELD OF THE INVENTION

The present invention relates to a bucket for attachment to a loader, the bucket having a hydraulic drum with ground engaging teeth mounted near the bottom of the bucket distal to the bucket leading edge.

BACKGROUND OF THE INVENTION

A typical loader is a utility vehicle containing a rigid frame, a pair of lift arms, and four wheels or tracks. Typically, the lift arms are removably affixed to a bucket for scooping, moving, and loading. A loader is used to complete tasks in several construction, farm, and utility environments in all seasons and weather with ease.

Several different attachments can be attached to the lift arms of some styles of loaders. One of the more common attachments is a bucket. This bucket is often used to scrape, scoop, move, and pulverize ground and materials. Often, during use a user may need to use to several varying attachments to complete a given task. Therefore, there is a need for a device that combines attachments and adds versatility to the standard bucket.

SUMMARY OF THE INVENTION

The device includes a bucket with an integrated hydraulic cylinder for a loader. The bucket forms an enclosed cavity with an interior for scooping and loading materials and is bounded on four sides by a pair of sidewalls, a rear wall connected to the sidewalls, and a bottom side. The bottom side is connected to the sidewalls and rear wall and has a leading edge opposite the rear wall. The leading edge provides the main contact point for scooping and loading the bucket during use.

The bucket is attached to the loader using an attachment means mounted on an exterior of the rear wall and suitable hydraulic connections. The preferred attachment means is a quick release containing a pair of apertures located on a strut of the rear wall exterior. These apertures allow for the quick attachment connections located on many standard hydraulic loaders, such as a skid steer. This attachment means and hydraulic connections allow the user to alter the pitch and height of the bucket, allowing the angle and height of the bucket to be adjusted. Preferably, the bucket is constructed out of heavy gauge steel plate to withstand use. Although, a standard quick connect is the preferred attachment means, other attachment means may be used such as apertures with pins, fasteners, or other similar securing object.

The leading edge may contain a cutting edge to facilitate the scouring and cutting of dirt and materials during use. This cutting edge is preferably removably fastened to the edge to allow for replacement and sharpening. Preferably, this fastening mechanism is a bolt or other similar removable and common fastener.

A pocket is formed on the exterior of the bucket opposite the interior cavity. The pocket extends a width of the bucket and is sized to receive the hydraulic cylinder. Preferably, the pocket is positioned distal the leading edge at a lower end of the rear wall adjacent to the bottom side. The pocket sides are defined by the pair of the sidewalls with the sidewalls including an aperture for access to the pocket and the mounting hardware for the hydraulic cylinder. The pocket is integrated into the exterior of the bucket and defines an interior for enclosing the hydraulic cylinder. The pocket interior includes a first side on the exterior of the bucket opposite the cavity and a second side opposite the first side. A first cutting edge on the first side and second cutting edge on the second side extend a width of the pocket and form a shear point for the hydraulic cylinder when it is mounted with the pocket. The cutting edges facilitate the removal of debris from the rotating cylinder.

The hydraulic cylinder is affixed to the bucket within the pocket extending the width of the bucket. The hydraulic cylinder is powered by a hydraulic motor. The hydraulic motor may be enclosed within a housing motor mount and mounted within the hydraulic cylinder to conserve space. The hydraulic cylinder is hollow and includes bearings to allow rotation of the hydraulic cylinder. The hydraulic motor provides bi-directional rotational energy to the hydraulic cylinder. The hydraulic cylinder location at the exterior of the bucket allows a user to manipulate materials on a ground surface at the underside and backside of the bucket.

The hydraulic cylinder contains a plurality of ground engaging teeth. The ground engaging teeth extend perpendicular to the rotational axis of the hydraulic cylinder and provide a cutting force to material. The teeth may be rounded or pointed at an end and be composed of steel, carbide, or other similar hardened material. Additionally, the teeth may be arranged in a pattern or randomly placed across the circumference of the hydraulic cylinder.

Preferably, the hydraulic cylinder is mounted at a lower corner of the bucket distal to the leading edge and positioned to allow for easy use. Preferably, this mounting point is a fixed distance to allow for a correlation between a height of the leading edge and a cutting depth of the ground engaging teeth, wherein a pitch of the leading edge upward will heel the bucket and engage the hydraulic cylinder a depth corresponding to the height of the upward pitch.

BRIEF DESCRIPTION OF THE SEVERAL VIEWS OF THE DRAWING(S)

The accompanying drawings are included to provide a further understanding of the present invention and are incorporated in and constitute a part of this specification. The drawings illustrate exemplary embodiments of the present invention and together with the description serve to further explain the principles of the invention. Other aspects of the invention and the advantages of the invention will be better appreciated as they become better understood by reference to the Detailed Description when considered in conjunction with accompanying drawings, and wherein.

DETAILED DESCRIPTION OF THE INVENTION

Figure 1:
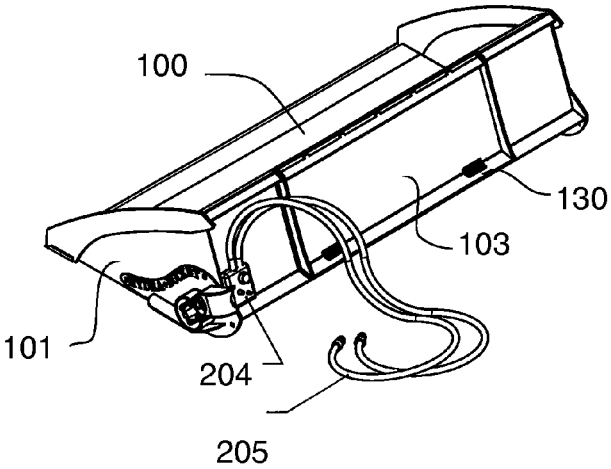
FIG. 1 is a rear perspective view of the bucket with integrated hydraulic drum, according to the present invention.
Figure 2:
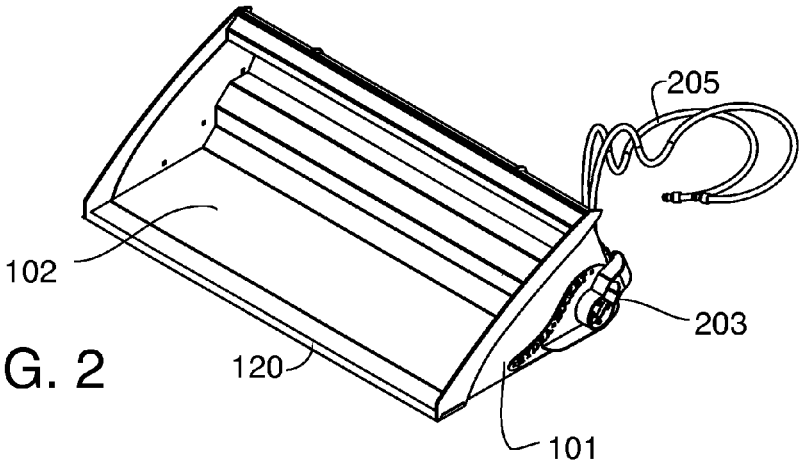
FIG. 2 is a front perspective view of the top of the bucket with integrated hydraulic drum, according to the present invention.

Referring now to FIG. 1-8 of the bucket with an integrated hydraulic cylinder for a loader according to the present invention generally referred to as device 10. The device 10 includes a bucket 100 and a hydraulic powered cylinder 200. The bucket 100 forms an enclosed cavity with an interior for scooping and loading materials and is bounded on four sides by a pair of sidewalls 101, a rear wall 103 connected to the sidewalls 101, and a bottom side 102. The bottom side 102 is connected to the sidewalls 101 and rear wall 103 and has a leading edge 120 opposite the rear wall 103. The leading edge 120 provides the main contact point for scooping and loading the bucket 100 during use.

The bucket 100 is attached to the skid loader using an attachment means 130 mounted on an exterior of the rear wall 103 and suitable hydraulic connections 204, 205. The preferred attachment means 130 is a quick release containing a pair of apertures located on a strut of the rear wall 103 exterior. These apertures allow for the quick attachment connections located on many standard hydraulic loaders, such as a skid steer. This attachment means 130 and hydraulic connections allow the user to alter the pitch and height of the bucket 100, allowing the angle and height of the bucket 100 to be adjusted. Preferably, the bucket 100 is constructed out of heavy gauge steel plate to withstand use. Although, a standard quick connect is the preferred attachment means, other attachment means may be used such as apertures with pins, fasteners, or other similar securing object.

The leading edge 120 may contain a cutting edge to facilitate the scouring and cutting of dirt and materials during use. This cutting edge is preferably removably fastened to the edge 120 to allow for replacement and sharpening. Preferably, this fastening mechanism is a bolt or other similar removable and common fastener.

A pocket 104 is formed on the exterior of the bucket 100 opposite the interior cavity. The pocket 104 extends a width of the bucket 100 and is sized to receive the hydraulic cylinder 200. Preferably, the pocket 104 is positioned distal the leading edge 120 at a lower end of the rear wall 103 adjacent to the bottom side 102. The pocket 104 sides are defined by the pair of the sidewalls 101 with the sidewalls 101 including an aperture 110 for access to the pocket 104 and the mounting hardware for the hydraulic cylinder 200. The pocket 104 is integrated into the exterior of the bucket 100 and defines an interior for enclosing the hydraulic cylinder 200. The pocket 104 interior includes a first side 141 on the exterior of the bucket 100 opposite the cavity and a second side 142 opposite the first side 141. A first cutting edge 121 on the first side 141 and second cutting edge 122 on the second side 142 extend a width of the pocket 104 and form a shear point for the hydraulic cylinder 200 when it is mounted with the pocket 104. The cutting edges facilitate the removal of debris from the rotating cylinder 200.

The hydraulic cylinder 200 is affixed to the bucket 100 within the pocket 104 extending the width of the bucket 100. The hydraulic cylinder is powered by a hydraulic motor 210. The hydraulic motor 210 may be enclosed within a housing motor mount 203 and mounted within the hydraulic cylinder 200 to conserve space. The hydraulic cylinder 200 is hollow and includes bearings 211 to allow rotation of the hydraulic cylinder 200. The hydraulic motor 210 provides bi-directional rotational energy to the hydraulic cylinder 200. The hydraulic cylinder 200 location at the exterior of the bucket 100 allows a user to manipulate materials on a ground surface at the underside and backside of the bucket 100.

The hydraulic cylinder 200 contains a plurality of ground engaging teeth 201. The ground engaging teeth 201 extend perpendicular to the rotational axis of the hydraulic cylinder 200 and provide a cutting force to material. The teeth 201 may be rounded or pointed at an end and be composed of steel, carbide, or other similar hardened material. Additionally, the teeth 201 may be arranged in a pattern or randomly placed across the circumference of the hydraulic cylinder 200.

Preferably, the hydraulic cylinder 200 is mounted at a lower corner of the bucket 100 distal to the leading edge 120 and positioned to allow for easy use. Preferably, this mounting point is a fixed distance to allow for a correlation between a height of the leading edge 120 and a cutting depth of the ground engaging teeth 201, wherein a pitch of the leading edge 120 upward will heel the bucket and engage the hydraulic cylinder 200 a depth corresponding to the height of the upward pitch.

Figure 3:
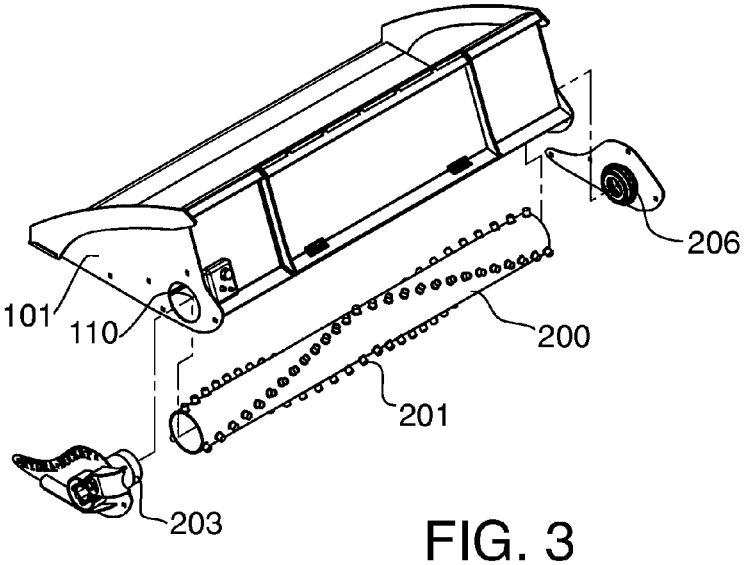
FIG. 3 is a rear exploded view of the bucket with integrated hydraulic drum, according to the present invention.
Figure 4:
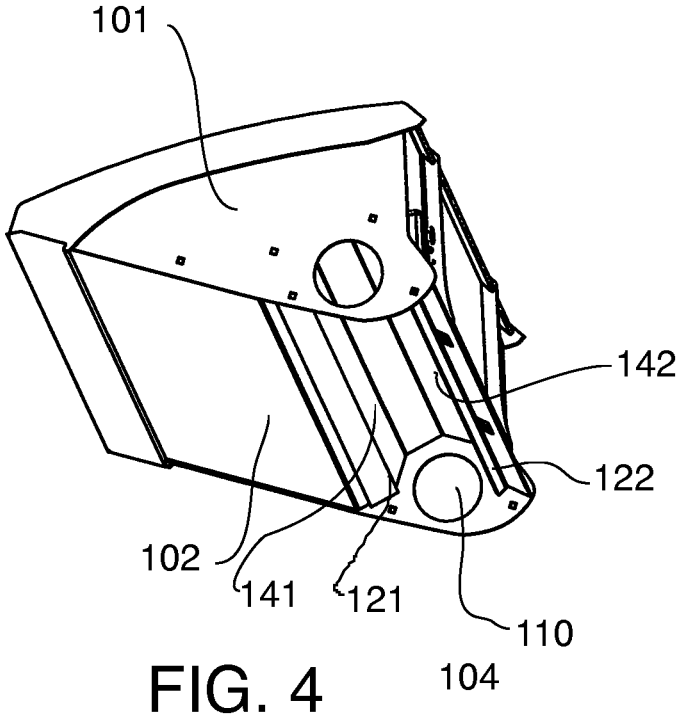
FIG. 4 is a bottom isometric view of the bucket with integrated hydraulic drum removed, according to the present invention.
Figure 5:
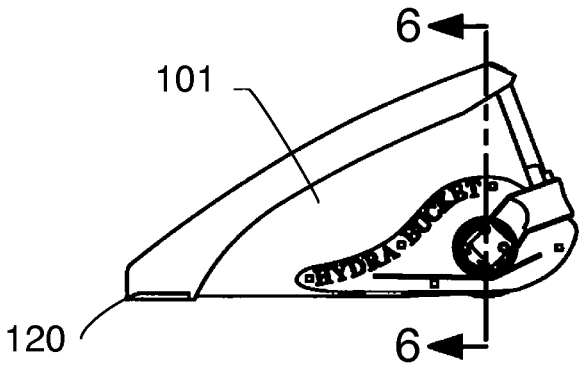
FIG. 5 is a side view of the bucket with integrated hydraulic drum, according to the present invention.
Figure 6:
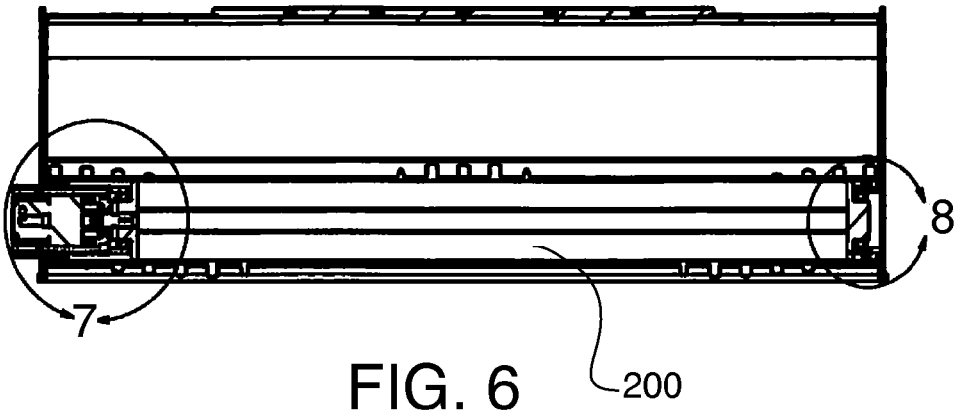
FIG. 6 is a rear view of the bucket with integrated hydraulic drum along section line 6-6 of FIG. 5, according to the present invention.
Figure 7:
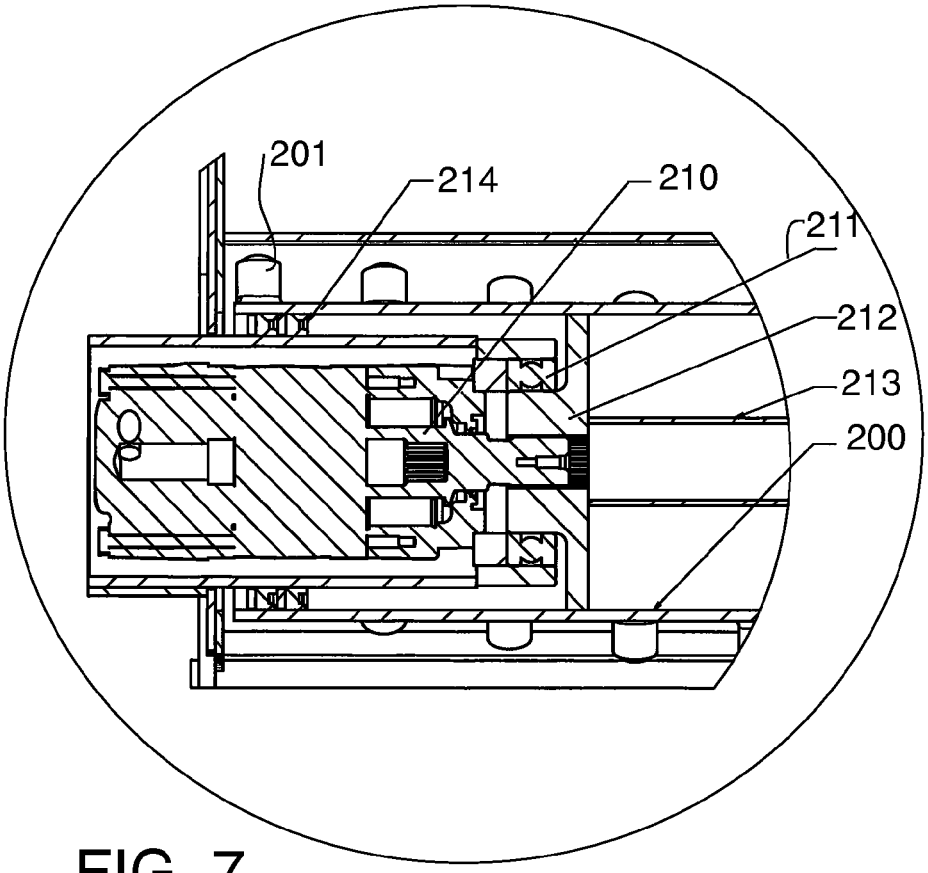
FIG. 7 is a close up view of the bucket with integrated hydraulic drum as indicated in call-out 7 of FIG. 6, according to the present invention.
Figure 8:
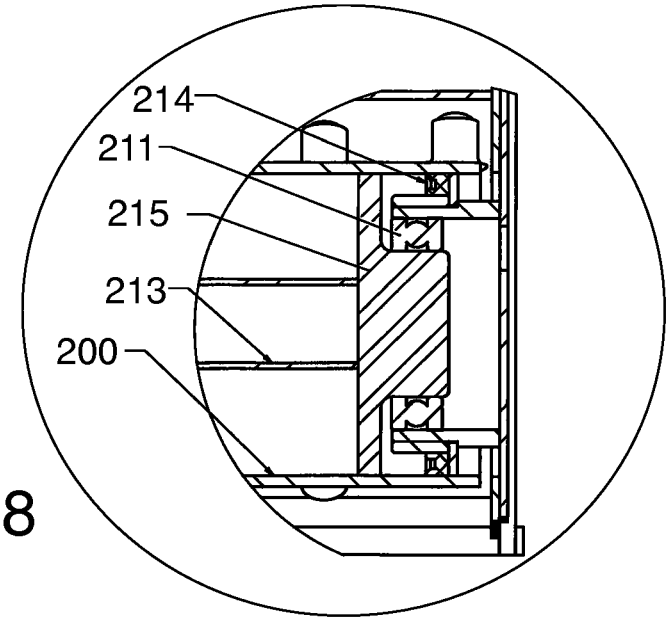
FIG. 8 is a close up view of the bucket with integrated hydraulic drum as indicated in call-out 8 of FIG. 6, according to the present invention.

Referring now specifically to FIG. 3, FIG. 7, and FIG. 8, the hydraulic cylinder 200 is mounted within the pocket 104 by the housing motor mount 203 and a cylinder mount 206. The mounts 203 and 206 are affixed to the sidewalls 101 and protrude through the aperture 110. The mounts 203, 206 contain various components received with the hollow hydraulic cylinder 200 to facilitate its use and operation. It is understood that several combinations of these components may be used with similar results and the components listed within this specification only represent exemplary and preferred combinations. Preferably, the housing motor mount 203 contains the hydraulic motor 210. This motor 210 is received within the hydraulic cylinder 200 and spins a spline engaged with a drive flange 212 mounted in the cylinder 200 interior. The drive flange 212 rotates against a bearing 211 affixed to the housing motor mount 203. The motor mount 203 is sealed within the cylinder 200 with a grease seal 214. The grease seal 214 prevents debris from entering the cylinder 200 interior. An alignment tube 213 is shown in the interior, this tube 213 is used during manufacturing to ensure proper alignment on the cylinder sides and ensure true rotation.

The cylinder mount 206 is received within the cylinder 200 interior and includes a bearing 211. The bearing 211 receives the coast flange 215 and allows for rotation. The coast flange 215 is affixed to the drum 200 interior and provides rotational support. The mount 206 is sealed with the cylinder with the grease seal 214.

In use, a user will mount the device 10 to the attachment arms of a loader and make the appropriate hydraulic connections. The user can utilize the device 10 to complete a variety of tasks utilizing both the bucket 100 and hydraulic cylinder 200. These tasks may include using the device 10 to, but not be limited to, level dirt, till ground, pulverize dirt, grind stumps, pick rocks, condition soil, or give traction to iced concrete.

The hydraulic components of the device 10, may include a hydraulic motor 210, hydraulic hoses 205, and hydraulic valves 204. Although hydraulic controls are preferred, it is understood that other power sources may be used such as electrical or mechanical components although hydraulic is preferred for its compatibility with the existing components of a common loader.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) but that the invention will include all embodiments falling with the scope of the appended claims.

The invention claimed is:

1. A surface manipulating device for attachment to a loader, the device comprising:

a bucket, the bucket having:

a bottom side, the bottom side having a leading edge, the leading edge opposite a rear wall;

the rear wall, the rear wall in communication with the bottom side;

a pair of sidewalls defining a width of the bucket, the sidewalls in communication with the bottom side and rear wall, the sidewalls, rear wall, and bottom side forming an interior cavity for moving and loading contents, the sidewalls each having an aperture; and a pocket, the pocket formed on an exterior of the bucket opposite the interior cavity, the pocket at a lower corner distal to the leading edge adjacent to the apertures, the pocket extending the width of the bucket;

a cylinder, the cylinder entirely received within the pocket for rotational movement and having:

a plurality of ground engaging teeth, the plurality of ground engaging teeth extending perpendicular to the rotational axis of the hydraulic cylinder a height not exceeding the pocket, wherein the ground engaging teeth are contained within the pocket; and a hollow interior;

a hydraulic motor, the hydraulic motor engaged with the cylinder to provide rotational movement and mounted within the hollow interior.

2. A device as claimed in claim 1, wherein the cylinder is capable of bi-directional movement.

3. A device as claimed in claim 1, wherein the rear wall includes a pair of apertures to allow for a quick connection.

4. A device as claimed in claim 1, wherein the pocket includes a pair of cutting edges, the pair of cutting edges extending the width of the pocket, the cutting edges each located on opposed sides of the pocket.

5. A device as claimed in claim 1, wherein the ground engaging teeth are carbide tipped.

6. A device as in claim 1, wherein movement of the bucket correlates to an equivalent movement of the cutting depth of the ground engaging teeth, wherein a movement of a height of the bucket leading edge upwards will result in an equal distance of cut downward and corresponding to this height of the leading edge.

* * * * *